United States Patent [19]

King, Jr.

[11] 4,306,358

[45] Dec. 22, 1981

[54] AIR DRYING APPARATUS

[75] Inventor: Frank C. King, Jr., Richmond, Va.

[73] Assignee: AMF Incorporated, White Plains, N.Y.

[21] Appl. No.: 66,711

[22] Filed: Aug. 15, 1979

[51] Int. Cl.[3] ..... F26B 3/22

[52] U.S. Cl. ..... 34/23; 34/41; 34/68; 34/155; 34/160; 131/372; 68/5 D; 162/375; 162/289;375;290;310;207; 131/133 R;136

[58] Field of Search ..... 34/155, 156, 160, 23, 34/34, 41, 68; 68/20, 5 D

[56] References Cited

U.S. PATENT DOCUMENTS

| | | | |
|---|---|---|---|
| 1,567,023 | 12/1925 | Larsson | 34/28 |
| 3,145,716 | 8/1964 | Geitz et al. | 131/133 R |
| 3,224,108 | 12/1965 | Flaming | 34/243 C |
| 3,228,113 | 1/1966 | Fannon, Jr. | 34/160 |
| 3,295,222 | 1/1967 | Geitz | 34/201 |
| 3,827,639 | 8/1974 | Relue et al. | 34/156 |

FOREIGN PATENT DOCUMENTS

| | | | |
|---|---|---|---|
| 2834897 | 3/1979 | Fed. Rep. of Germany | 34/155 |

*Primary Examiner*—Larry I. Schwartz
*Attorney, Agent, or Firm*—George W. Price; Charles J. Worth

[57] ABSTRACT

An apparatus for the drying of a slurry being conveyed on a movable support including a steam producing arrangement below the movable support forming a steam atmosphere. A film of condensed vapor is produced above the slurry caused by heat transfer through the movable support, and an air drying arrangement is adapted to propel a stream of air across the slurry surface so as to entrain the vapor therein and to remove it from the slurry.

22 Claims, 25 Drawing Figures

AIR DRYING APPARATUS

BACKGROUND OF THE INVENTION

1. Field of the Invention

The present invention relates to an air drying apparatus and, more particularly, to an apparatus for removing moisture from an aqueous slurry. Specifically, the invention is directed at an apparatus for the drying of a reconstituted tobacco slurry in a relatively rapid and uniform manner.

2. Discussion of the Prior Art

Currently employed processes and apparatuses for the drying of aqueous slurries, such as reconstituted tobacco slurries, utilize expensive and cumbersome air hoods, chambers and duct work which are positioned above and about a tobacco sheet forming band. The drying apparatuses distribute, collect and convey the air which is required for the removal of the water vapor from the surface of the slurry. Heretofore, these hood, chamber and ducting structures have been necessary to ensure extremely uniform drying rates of high quality reconstituted tobacco products, such as cigar wrappers and binders. These processes and apparatuses, however, have proven themselves to be so complex in construction as not to be cost effective.

Among apparatuses of this type there is one in which a heating medium, such as steam, is dispensed below an endless belt conveying an aqueous slurry so as to cause water to evaporate from the slurry. An air flow is effected across the slurry which will entrain the evaporated slurry water and remove it from the apparatus. This earlier apparatus necessitates the use of complex and bulky hoods and conduits, rendering it difficult to monitor the uniformity of drying of the slurry.

Also known in the art are various types of heating and air drying apparatuses in which heat and/or an air jet is applied to an aqueous slurry or web so as to evaporate and remove moisture therefrom. Among such prior art publications are U.S. Pat. Nos. 3,228,113 to Fannon, Jr.; 1,373,396 to Andrews; 3,417,484 to McCarthy; and 3,590,493 to Gretz. None of these earlier patents disclose a fully satisfactory method or apparatus for the rapid and uniform removal of moisture from an aqueous slurry to a degree necessitated for a reconstituted tobacco slurry.

Further known is an air drying apparatus in which a slurry of reconstituted tobacco is conveyed on a foraminous belt which will allow moisture from the slurry to seep through the belt. This, in essence, will result in an impermissible loss of nicotine from the slurry, necessitating the separation of the nicotine from the removed moisture, and replacing the nicotine in the dried tobacco product.

It is of importance in the drying of slurries, particularly as applied to reconstituted tobacco slurries that, in order to obtain a high quality tobacco product, there be effected a rapid and uniform drying of the slurry through the utilization of an apparatus which will provide the desired results heretofore unattainable in the prior art while being so cost effective and economical as to be competitive in the marketplace.

SUMMARY OF THE INVENTION

Accordingly, it is an object of the present invention to provide a simple and dependable apparatus for the drying of a slurry.

It is a more specific object of the present invention to provide an air drying apparatus employing streams of air for removing evaporated moisture from a slurry, such as a reconstituted tobacco slurry, in a rapid and uniform manner.

Still another object of the present invention is to provide an air drying apparatus of the type described in which a steam producing arrangement is disposed below an endless movable conveyor belt supporting the slurry so as to produce a steam atmosphere below the belt causing evaporation of moisture from the slurry, and in which air jets will propel a stream of drying air across the slurry to remove the water vapor present above the slurry.

Yet another object of the present invention is to provide an air drying apparatus for a slurry as described which will ensure a uniform and rapid drying of the slurry and in which the apparatus is of a simple and inexpensive construction requiring a minimum of duct work, maintenance and control so as to be extremely economical and cost effective both in capital investment and operation.

BRIEF DESCRIPTION OF THE DRAWINGS

Reference may now be had to the following detailed description of preferred embodiments of an air drying apparatus constructed pursuant to the invention, taken in conjunction with the accompanying drawings, in which.

DETAILED DESCRIPTION OF PREFERRED EMBODIMENT

Figure 1:
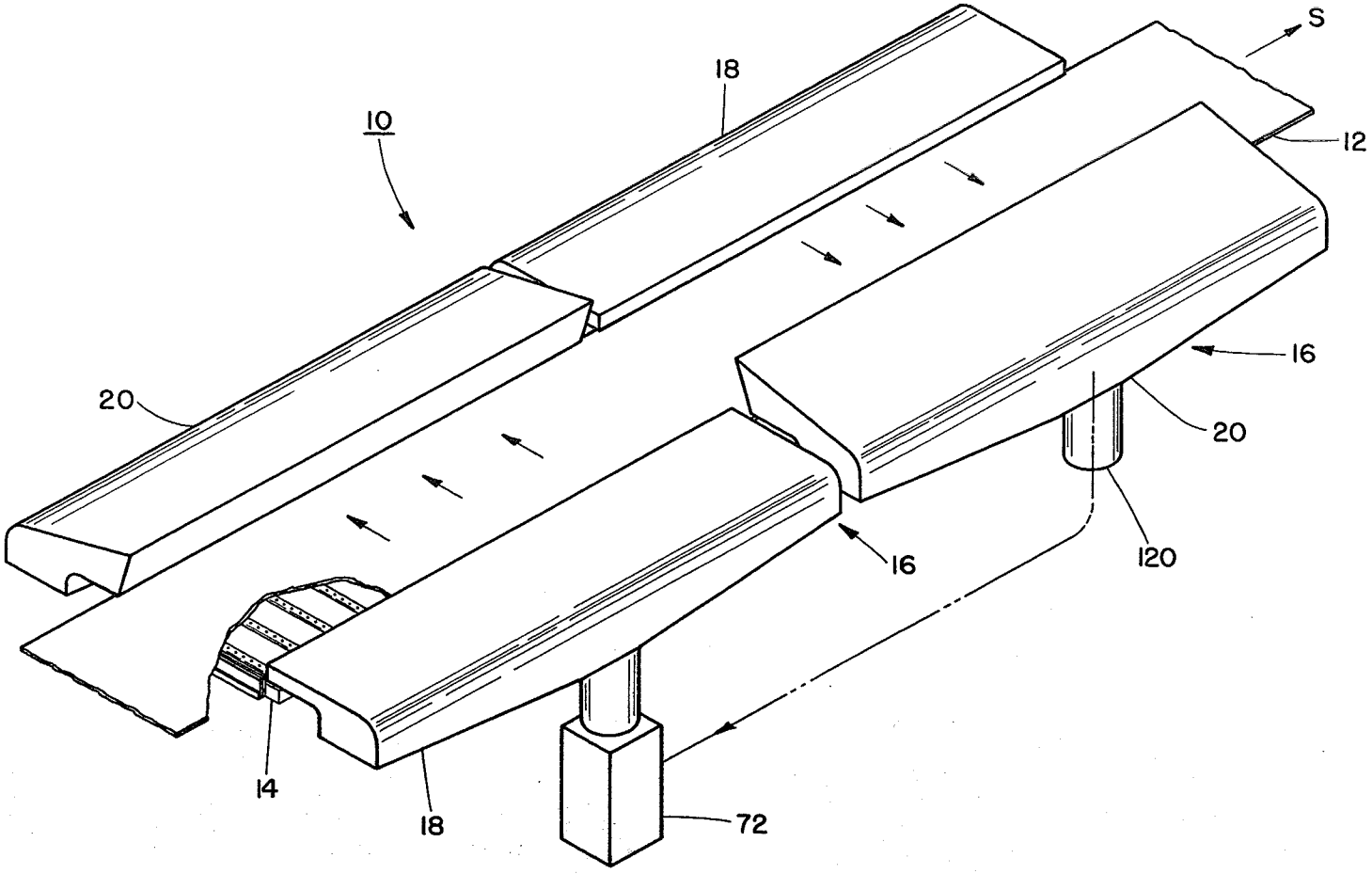
FIG. 1 is a generally schematic perspective view of an air drying apparatus in accordance with the present invention.
Figure 2:
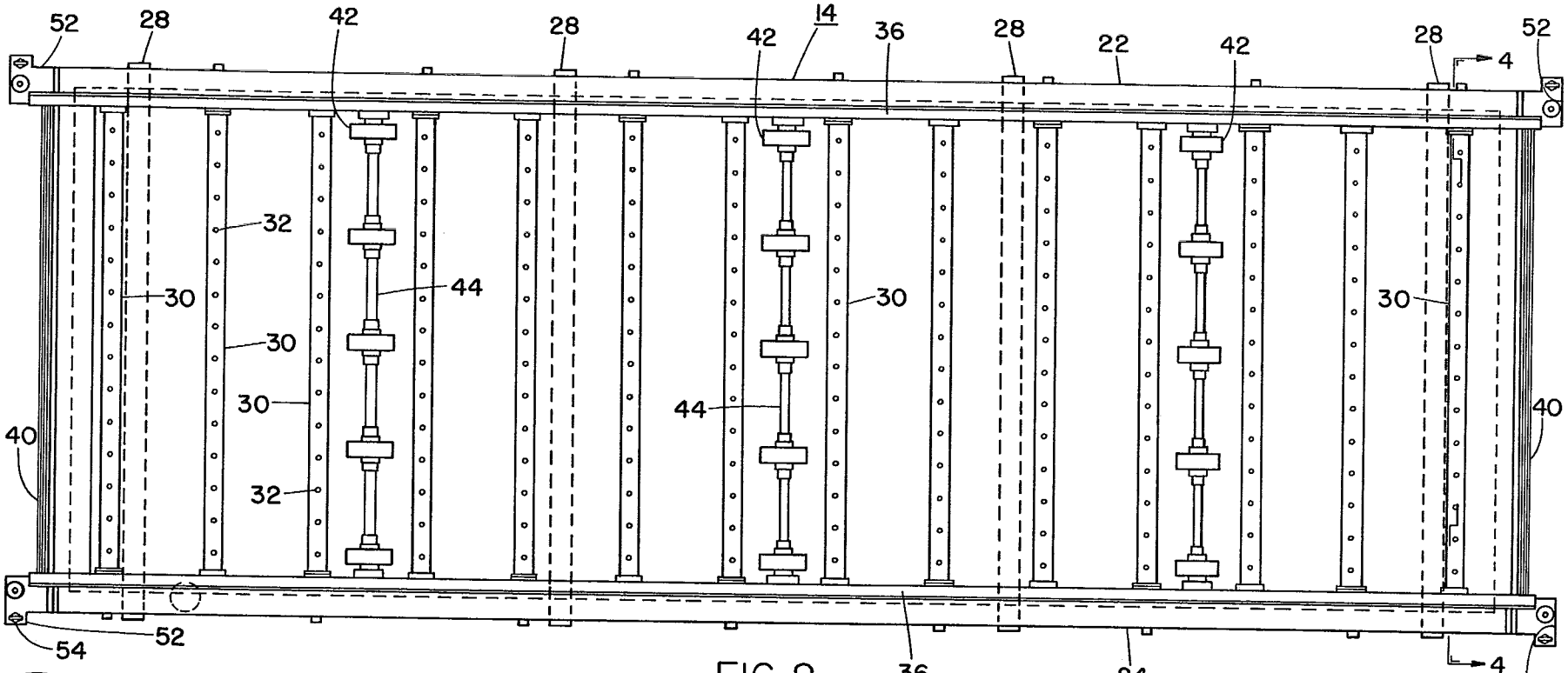
FIG. 2 is a top plan view of a steam box utilized in the inventive apparatus.
Figure 3:
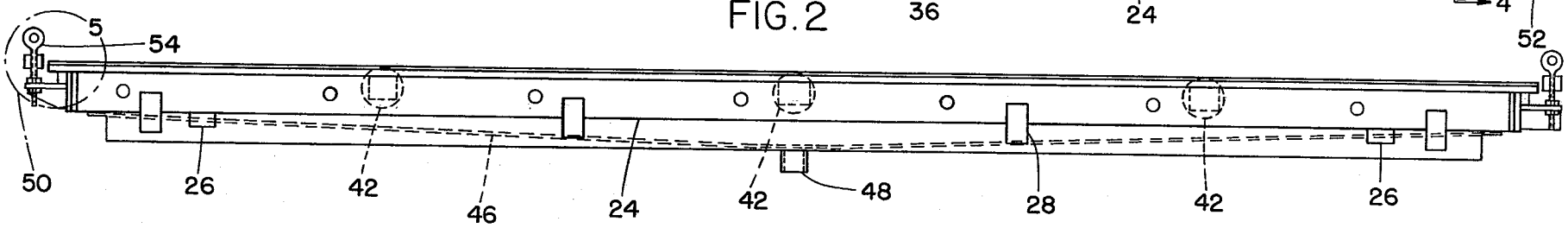
FIG. 3 is a side elevational view of the steam box of FIG. 3.

Referring now in detail to the drawings, and in particular to FIG. 1, the inventive slurry drying apparatus 10 includes an impervious endless movable stainless steel belt 12 of which the flat upper horizontal run supports a slurry in the form of a thin layer. The slurry may be constituted, for example, of a tobacco sheet from comminuted tobacco as is disclosed in copending and commonly assigned U.S. application Ser. No. 18,814 of Schmidt et al., filed Mar. 8, 1979 now abandoned and incorporated herein by reference. The upper run of the belt 12 is conveyed along the direction of arrow S at a predetermined rate of speed.

Arranged below the upper run of the belt 12 is at least one steam box assembly 14, described in greater detail in connection with FIGS. 2, 3, 4 and 5 of the drawings. The steam box assembly is adapted to eject steam against the lower surface of the upper run of the endless belt 12 so as to form a steam atmosphere in the space intermediate the steam box 14 and the undersurface of the upper run of the belt, and to resultingly produce a continuous film of condensing vapor above the endless belt 12 arising from the slurry which is supported thereon.

At least one air drying arrangement 16 is disposed along both longitudinal edges of the endless conveyor belt 12 and in substantial axial coextension with the steam box assembly 14 along the longitudinal length of the belt 12. The air drying arrangement 16 consists of at least one air outlet plenum 18 adapted to produce a stream of drying air flowing across and in close parallelism with the upper surface of the endless conveyor belt 12 in a direction towards the inlet of an air return plenum 20 which is located on the opposite side of the belt 12 in generally the same plane. As may be ascertained from the following detailed description of the slurry drying apparatus 10, a plurality of air drying arrangements 16 are provided along the path of travel of the endless conveyor belt 12 so as to constitute an elongate drying zone, and with a steam box assembly 14 being located below, respectively, each air drying arrangement 16.

With particular reference to FIGS. 2 through 5 of the drawings, each steam box assembly 14 includes a pair of parallel spaced elongate plenum chambers 22 and 24 extending along the longitudinal direction of the path of travel of the endless conveyor belt 12 below the opposite edges thereof. A suitable supply of steam is adapted to be supplied to each steam box assembly 14 through inlet connections 26 leading from a source of steam (not shown) to the plenum chamber 24. The plenum chambers 22 and 24 are interconnected into a rigid structure by suitable crossbars 28 so as to form a box-like structure. Communicating between the plenum chambers 22 and 24 are a series of transverse and parallel spaced conduit members 30, preferably of hollow tubular construction, each of which is provided with a large number of upwardly directed steam outlet orifices 32 of relatively small size spaced along the length thereof. As may be ascertained more clearly from FIG. 4 of the drawings, the plenum chambers 22 and 24 are also interconnected through each of the tubular conduits 32 by means of tie rods 34 extending through and located coaxially with the conduits 32.

Figure 4:
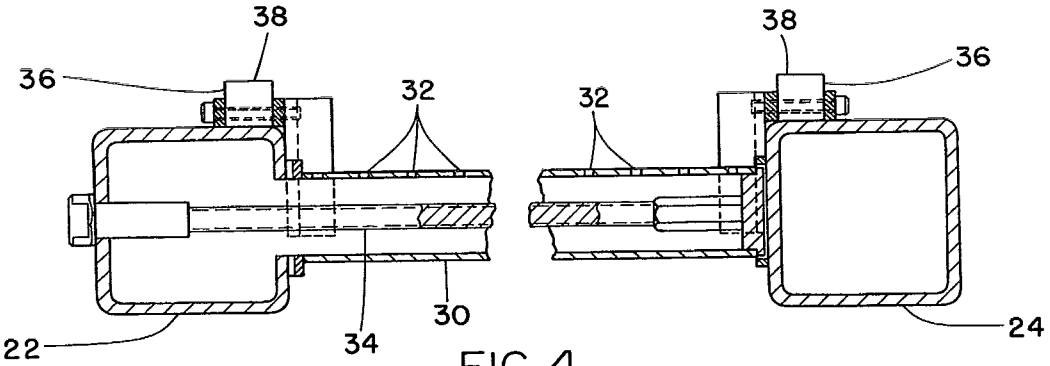
FIG. 4 is a sectional view, on an enlarged scale, taken along line 4—4 in FIG. 2.

With regard to the construction and interconnection of the steam conduits 30 and plenum chambers 22 and 24, the plurality of conduits 30 which are spaced along the length of each steam box assembly 14 alternatingly communicate at one end with either the plenum chambers 22 or the plenum chamber 24, as shown in the construction of FIG. 4, so that the steam as it traverses the conduits 30 from one end towards the other will pass from plenum 22 into a steam conduit 30 whereas the subsequent steam conduit 30 has the steam therein entering from the plenum 24.

In order to provide a sealed relationship between the steam box 14 and the bottom surface of the upper run of the endless conveyor belt 32, thereby preventing the escape of steam to the surrounding environment, extending along the length of each plenum 22 and 24 is a sealing bar 36, preferably of a rubber or synthetic sealing material, of which the upper surface 38 is in sliding and sealing contact with the bottom surface of the upper run of the endless conveyor belt 12 adjacent the edges of the latter. Furthermore, the longitudinally opposite ends of the steam box assembly 14 extending transversely of belt 12 are each provided with a similar transversely extending sealing member 40 in the form of a squeegee so as to effect the wiping off of any moisture condensing on the bottom surface of the endless belt 12 and to run down into the steam box assembly 14.

A plurality of freely rotatable rollers 42 is journaled on shafts 44 which extend between the plenum chambers 22 and 24, and with upper portion of the circumferential surfaces of the rollers 42 being at substantially the same plane as the upper surfaces 38 of the seal bars 36 in order to provide a generally horizontal support bearing arrangement for the upper run of the endless conveyor belt 12 as the belt with the thereon supported slurry is conducted over each steam box assembly 14. Interconnecting the plenum chambers 22 and 24 at the bottoms thereof and extending across the width therebetween defined by the length of conduits 30 is a condensate collector pan 46 which provides a closed box construction therewith and which slopes centrally downwardly in a trough-like manner towards the juncture with a condensate outlet connection 48 at the lowest point thereof so as to facilitate the egress of water formed by condensed steam in the steam box assembly 14.

Figure 5:
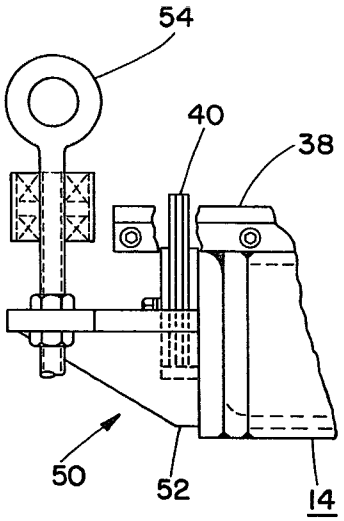
FIG. 5 is a fragmentary view, on an enlarged scale, of the encircled portion in FIG. 2.
Figure 7:
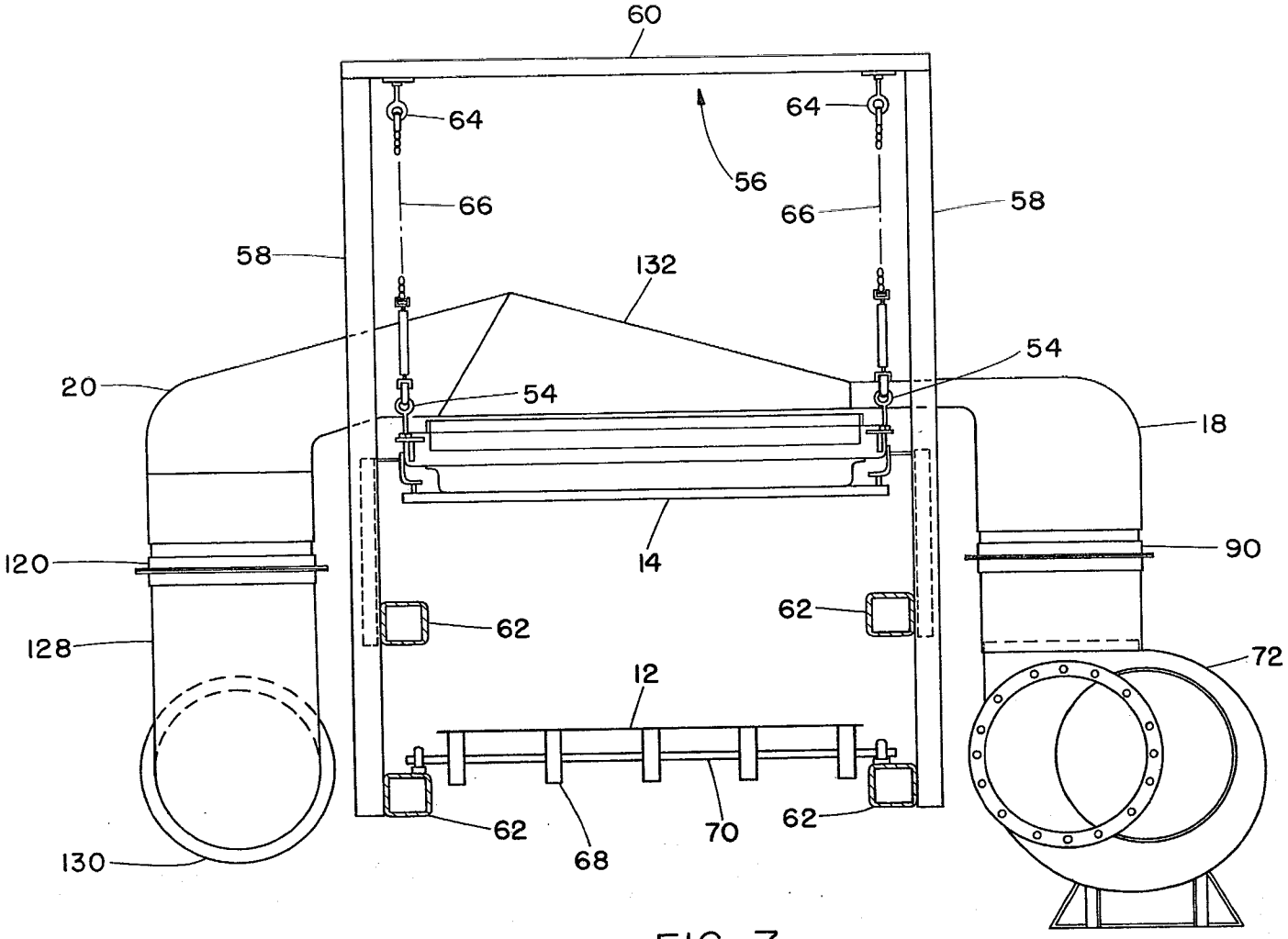
FIG. 7 is a sectional view, on an enlarged scale, taken along line 7—7 in FIG. 6*a;*

Mounted at each end or corner of the steam box assembly 14, having particular reference to FIG. 5 of the drawings, is a support arrangement 50 which includes an end bracket 52 to which there is fastened a vertically extending eyebolt 54. This will permit the steam box assembly 14 to be suspended from an overhead structure 56 as illustrated in FIG. 7 of the drawings. The structure 56 consists of vertical uprights 58 which are interconnected at their upper ends by a horizontal cross-beam 60, and are fastened at their lower ends to horizontal supports 62 for the dryer apparatus 10 so as to form a rigid framework. Depending from the cross-beam 60 are eyebolts 64 which, in turn, support cables 66 from which the entire steam box assembly is suspended below the upper run of belt 12 by means of the eyebolts 54 hooked to the lower ends of the cables. As a result, lateral movements or displacements of the endless conveyor belt 12 which rides on the rollers 42 supporting the upper belt run, and whose lower belt run is supported on rollers 68 journaled on shafts 70 which in turn, are supported on the lower supports 62, will not be transmitted to the steam box assembly 14.

Referring now to the drying air arrangement 16, as illustrated in FIGS. 6*a* through 6*c*, and FIGS. 8*a* through 8*c* of the drawings, the drying air arrangement consists of a plurality of drying air sections 16 arranged in series along the length of the upper run of the endless conveyor belt 12 so as to constitute an elongate drying zone for the slurry. Each drying air section 16 includes one air supply plenum 18 extending along one side of the belt 12 and an air return plenum 20 located on the opposite side of the belt so as to be coextensive and longitudinally aligned with the air supply plenum 18, with subsequent sections 16 being arranged whereby each air supply plenum 18 has an air return plenum arranged downstream thereof on the same side of the belt 12.

Each air supply plenum 18 has a blower 72 driven by a motor 74 associated therewith for conveying, preferably heated, dehumidified air thereto.

Figure 11:
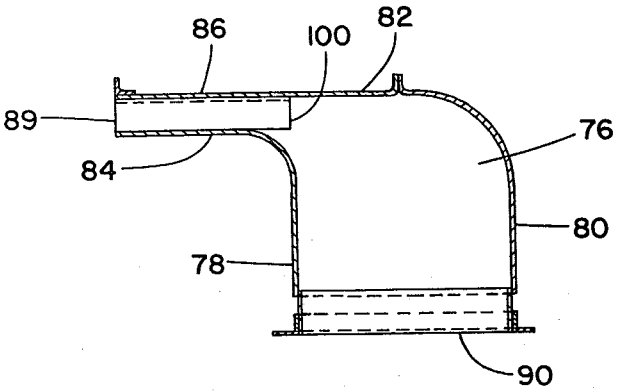
FIG. 11 is a sectional view taken along line 11—11 in FIG. 9.
Figure 8A:
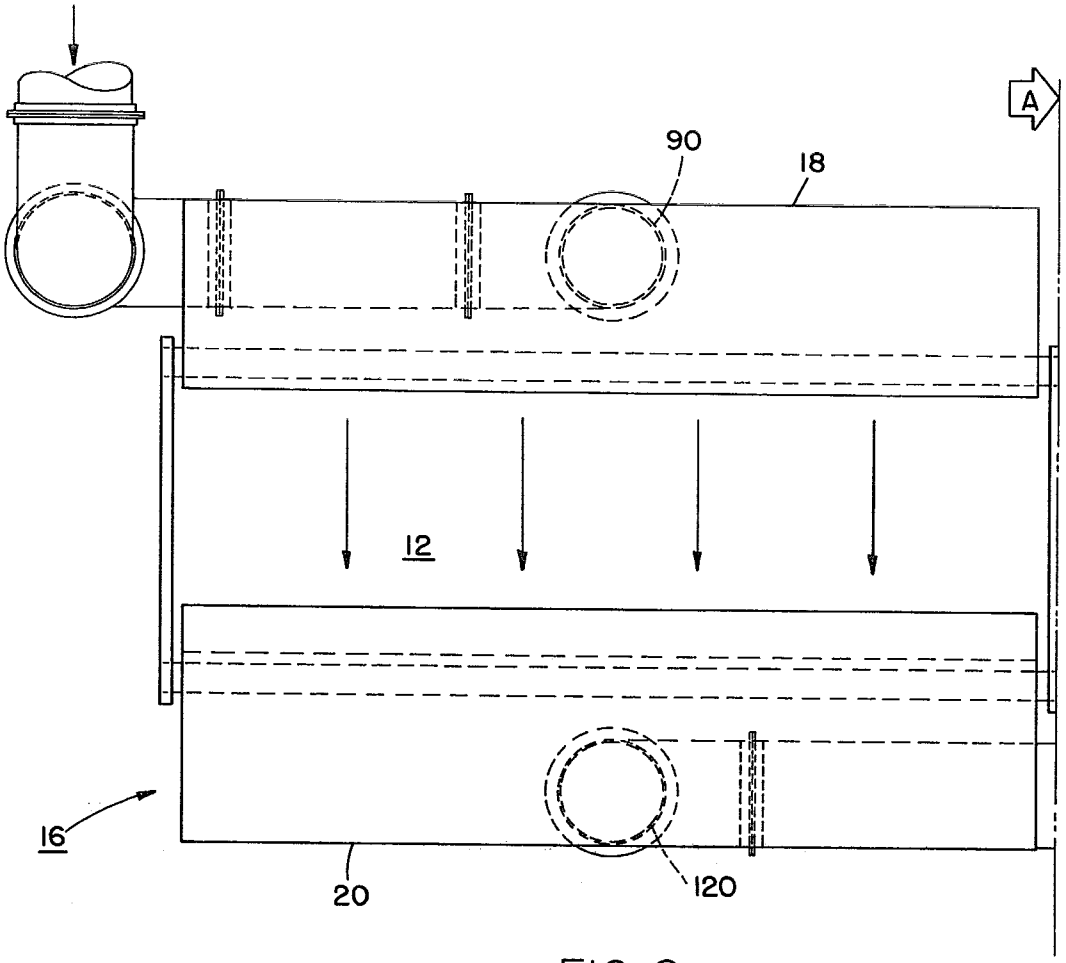
FIGS. 8*a* through 8*c* are a top plan view of the apparatus of FIGS. 6*a* through 6*c;*
Figure 8B:
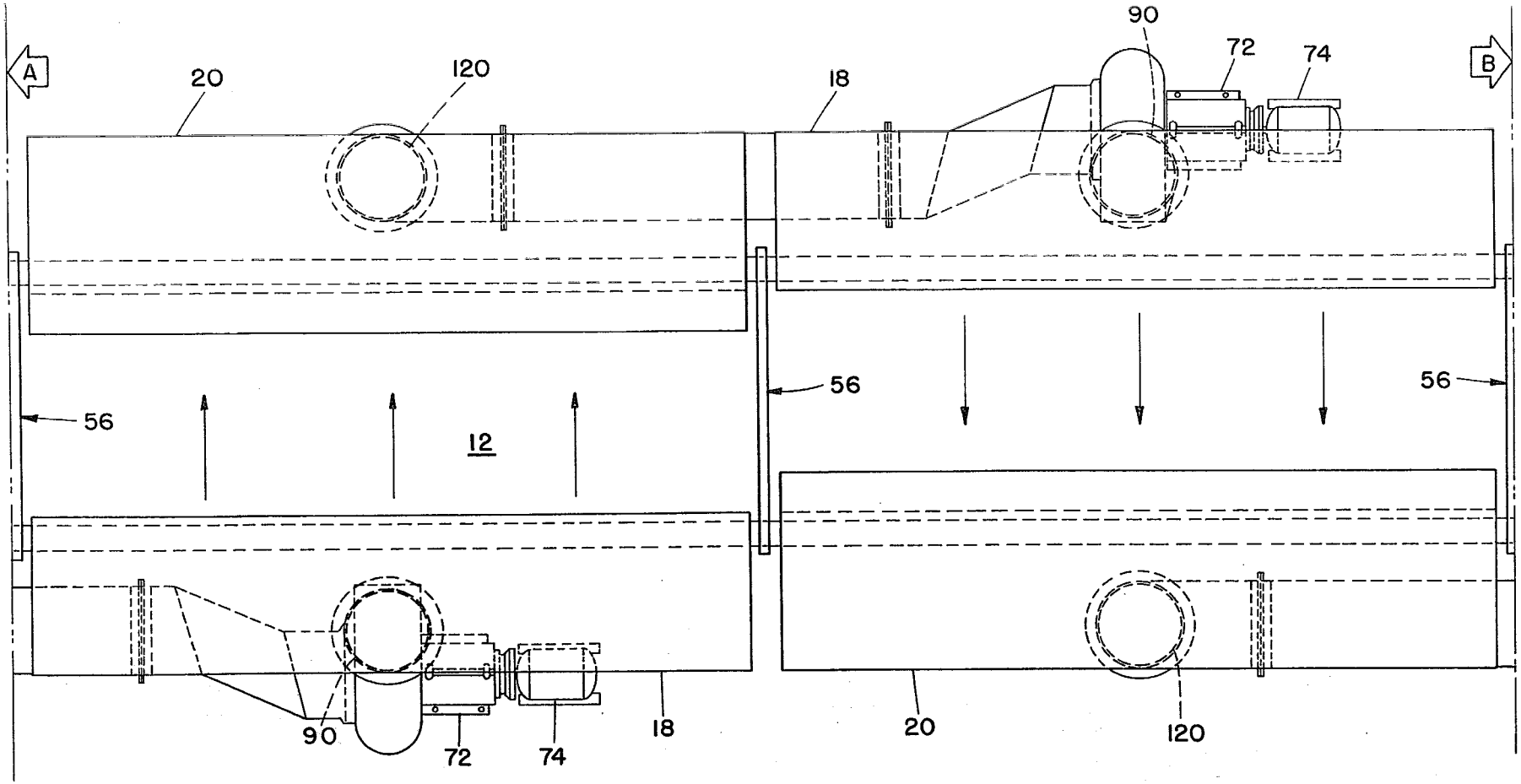
Figure 8C:
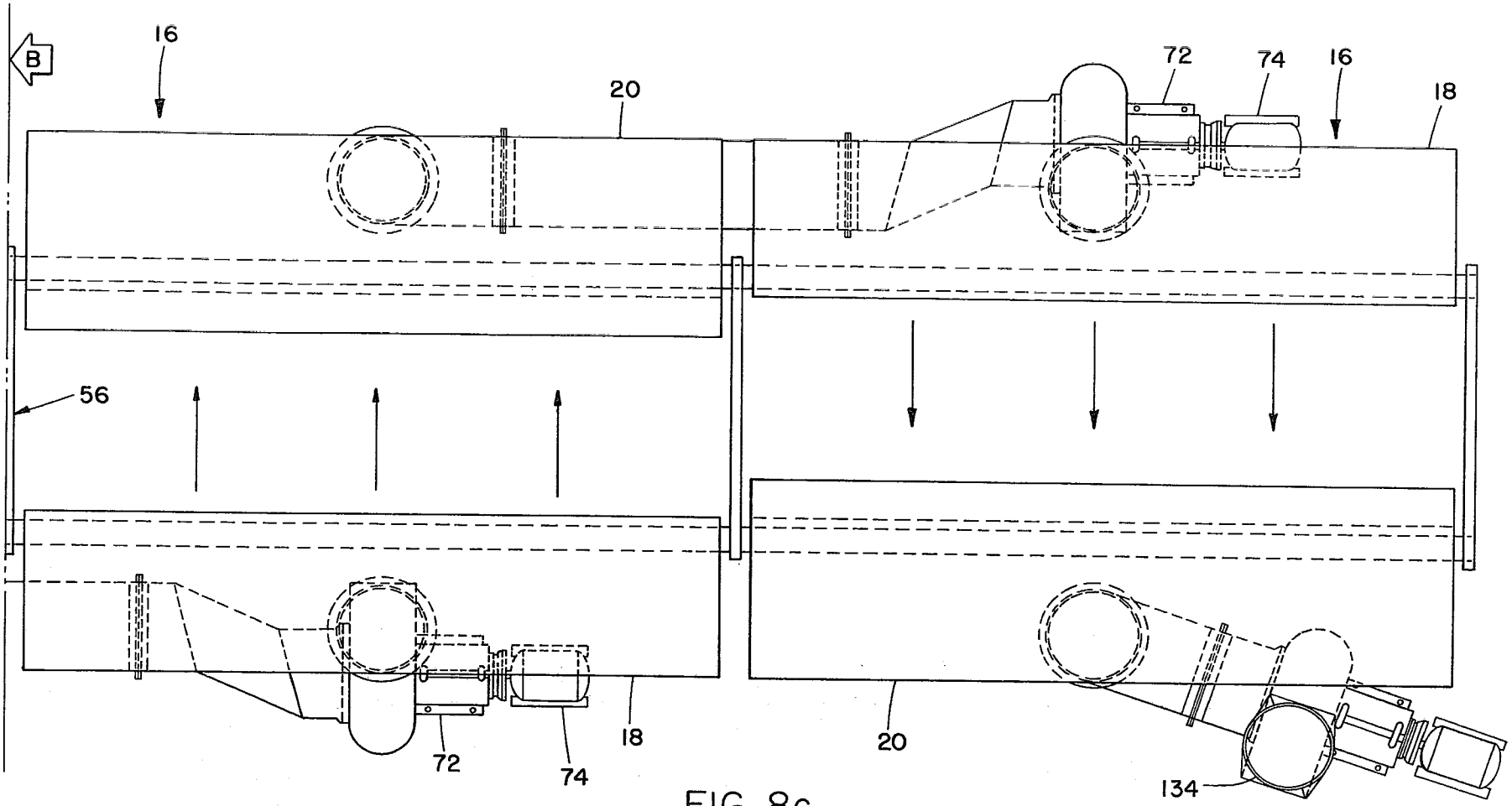
Figure 10:
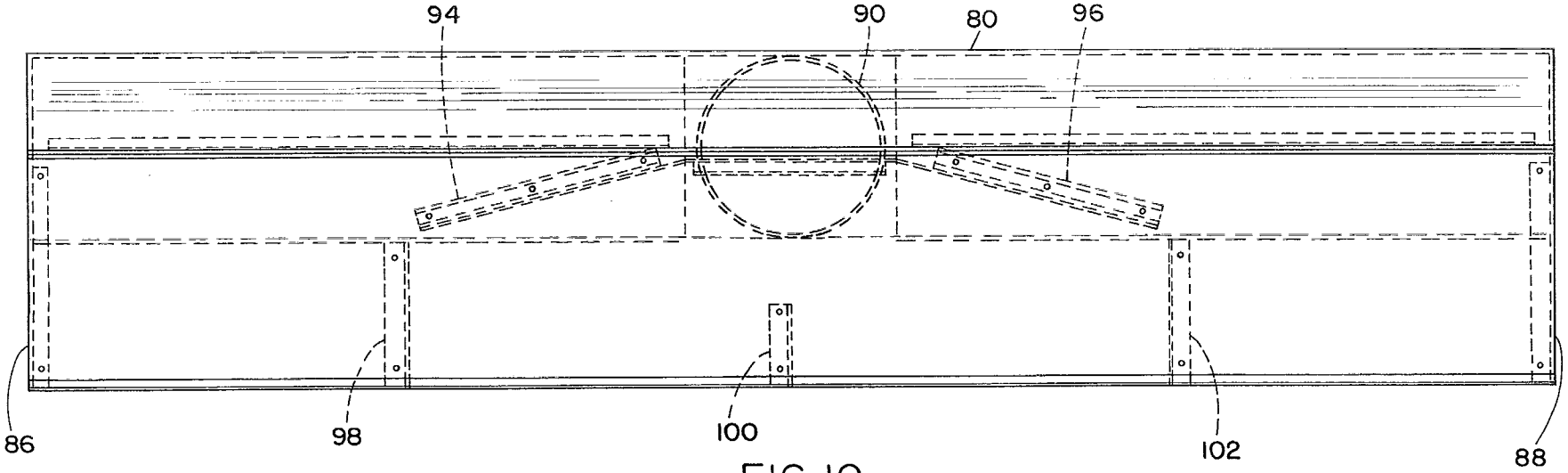
FIG. 10 is a top plan view of the air supply plenum.
Figure 9:
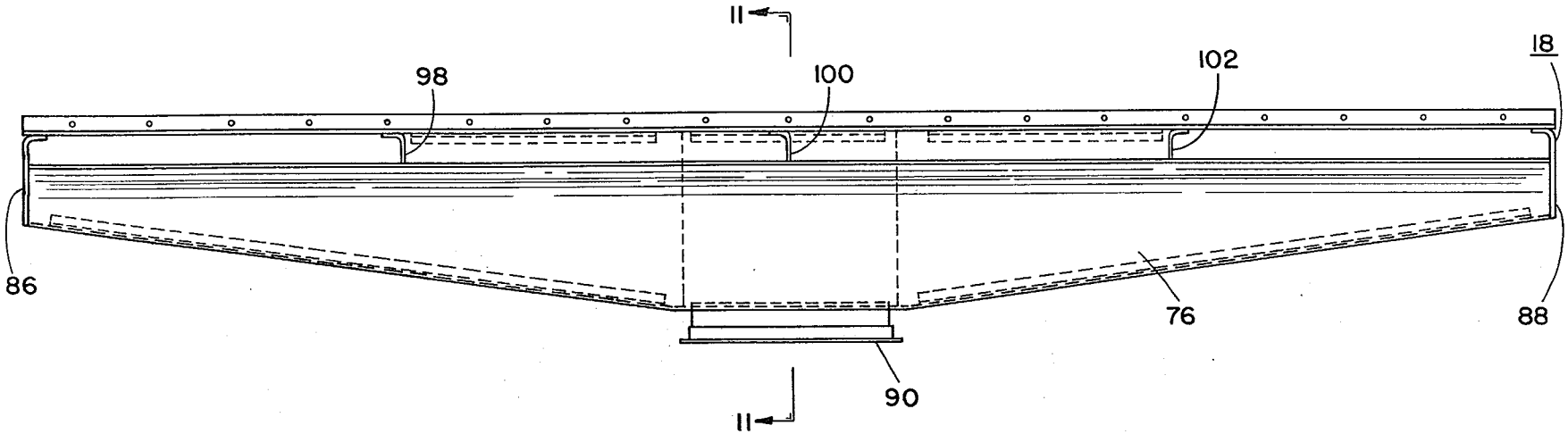
FIG. 9 is a front elevational view of an air supply plenum employed in the inventive apparatus.

As may be readily ascertained from FIGS. 9 through 11 of the drawings, each air supply plenum 18 is essentially constituted of sheet metal and includes an elongate vertical plenum chamber 76 having side wall closures 78 and 80, of which the latter curves upwardly so as to extend into a horizontal top closure plate 82, whereas the wall closure 78 extends into a horizontal wall 84. End walls 86 and 88 provide a substantially closed plenum structure with the other walls wherein the configuration thereof, as shown in FIG. 11, provides for a horizontally extending nozzle defining a generally narrow elongate and rectangular air outlet orifice 89. A generally circular air inlet connection 90 is provided at the bottom of the plenum chamber 76 for communication with a suitable air inlet duct 92 as illustrated in FIGS. 6*a* through 6*c* and FIGS. 8*a* through 8*c*, leading to the air blower 72.

The generally horizontally oriented air outlet nozzle 89 extends slightly above and parallel with the upper surface of the endless conveyor belt 12 which conveys the aqueous slurry through the drying zone of apparatus 10 in the direction of arrow S. In order to assure that the air exiting from the outlet orifice 89 is generally uniformly distributed therein and extends approximately normal to the plane of outlet orifice 89, angled baffles 94 and 96 divert the air so as to spread along the length of the plenum chamber 76, while baffles 98, 100 and 102 assure that the air flow out of the air nozzle 89 will be normal to its exit plane and directed transversely across and in close parallel relationship with the upper surface of the endless conveyor belt 12.

Figure 14:
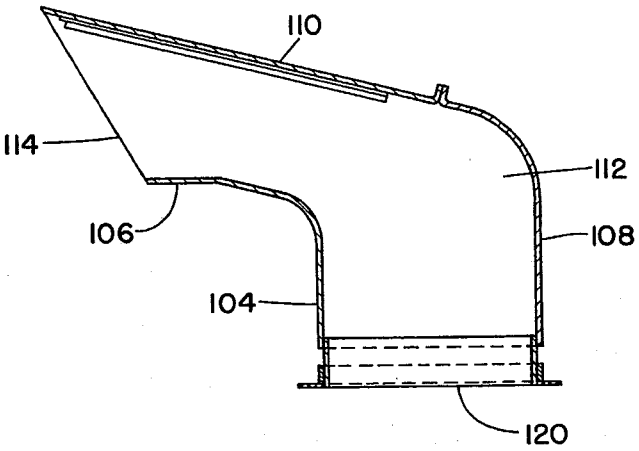
FIG. 14 is a sectional view taken along line 14—14 in FIG. 12.
Figure 13:
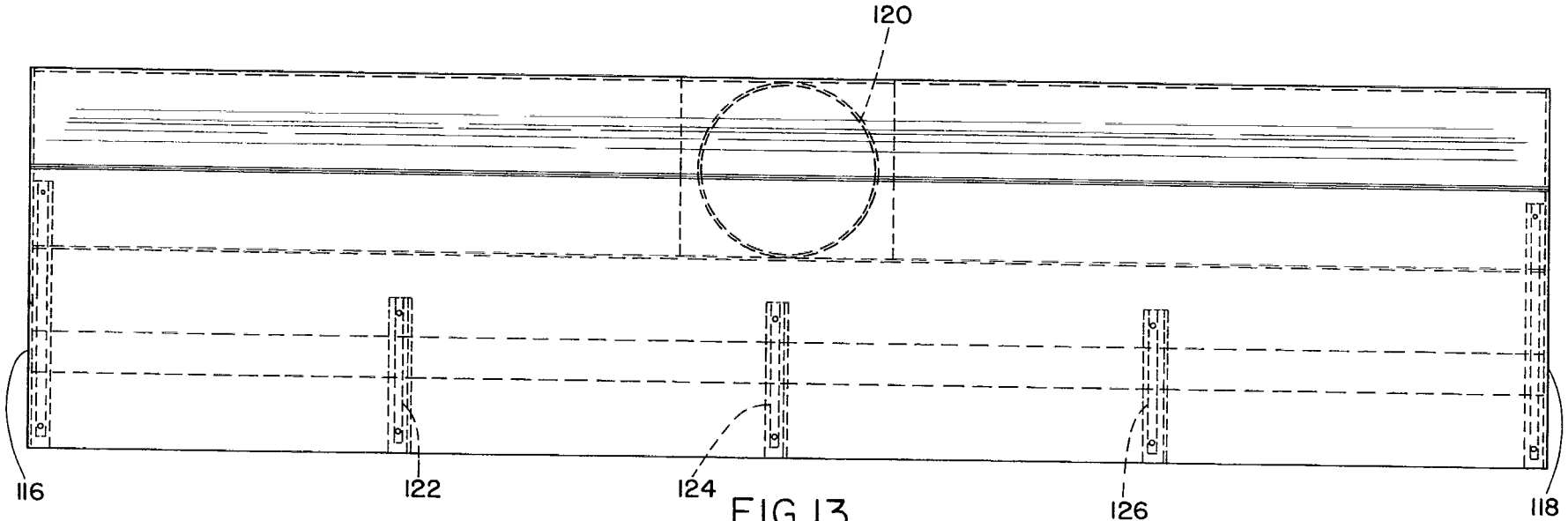
FIG. 13 is a top plan view of the air return plenum.
Figure 12:
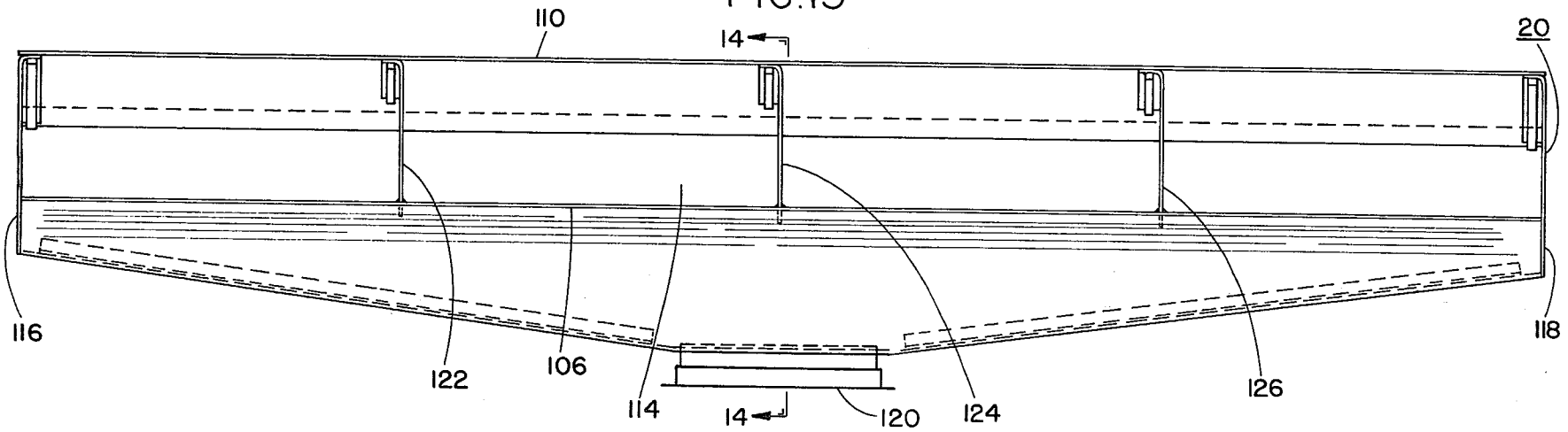
FIG. 12 is a front elevational view of an air return plenum employed in the inventive apparatus.

The air return plenum 20, as illustrated in FIGS. 12 through 14 of the drawings, has a somewhat similar construction as that of the air outlet plenum 18. In essence, the overall width of the air return plenum 20 is substantially identical to that of the air outlet plenum 18. Furthermore, the air return plenum 20 is provided with side walls 104 fairing into a horizontal wall 106 and a side wall 108 fairing into an upwardly sloped side wall 110 so as to form a plenum chamber 112 and a substantially converging air inlet orifice 114 of which the upper surface 110 is downwardly sloped towards the plenum 112. As may be ascertained from the drawings, the upwardly extending wall 110 projects beyond the lower wall 106 and is designed to provide a much higher orifice than the height of the air outlet nozzle 89, pertaining to which it is oppositely disposed above the upper run of the endless conveyor belt 12. End walls 116 and 118 provide a closed plenum chamber construction, with the air being adapted to be removed therefrom through a bottom conduit connector 120. A plurality of baffles or dividers 122, 124 and 126 are arranged within the return orifice 114 so as to direct the air inwardly of the plenum 112 in the absence of undue turbulence or vortex air flows.

The return air exiting through the conduit connector 120 is conducted through an elbow 128 into a conduit 130 leading to the blower 72 of an adjoiningly located air supply plenum 18.

The oppositely aligned end walls 86, 118 and 88, 116 of the respective plenums 18 and 20, as illustrated in FIG. 7 of the drawings, are interconnected by baffle plates 132 extending transversely across the belt 12 and are adapted to reduce losses in the high-velocity air exiting from the outlet orifices 89 which flows towards the return orifices 114 on the opposite side of the endless conveyor belt 12.

Figure 6C:
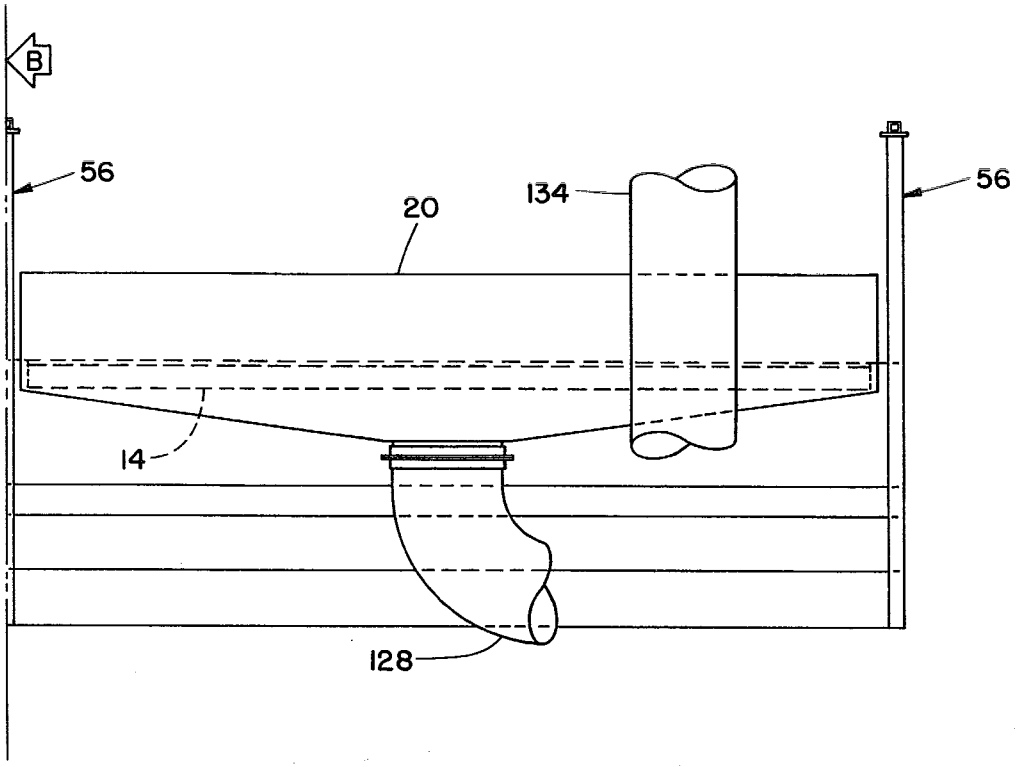
FIGS. 6*a* through 6*c* are a side elevational view of the air drying apparatus.
Figure 6A:
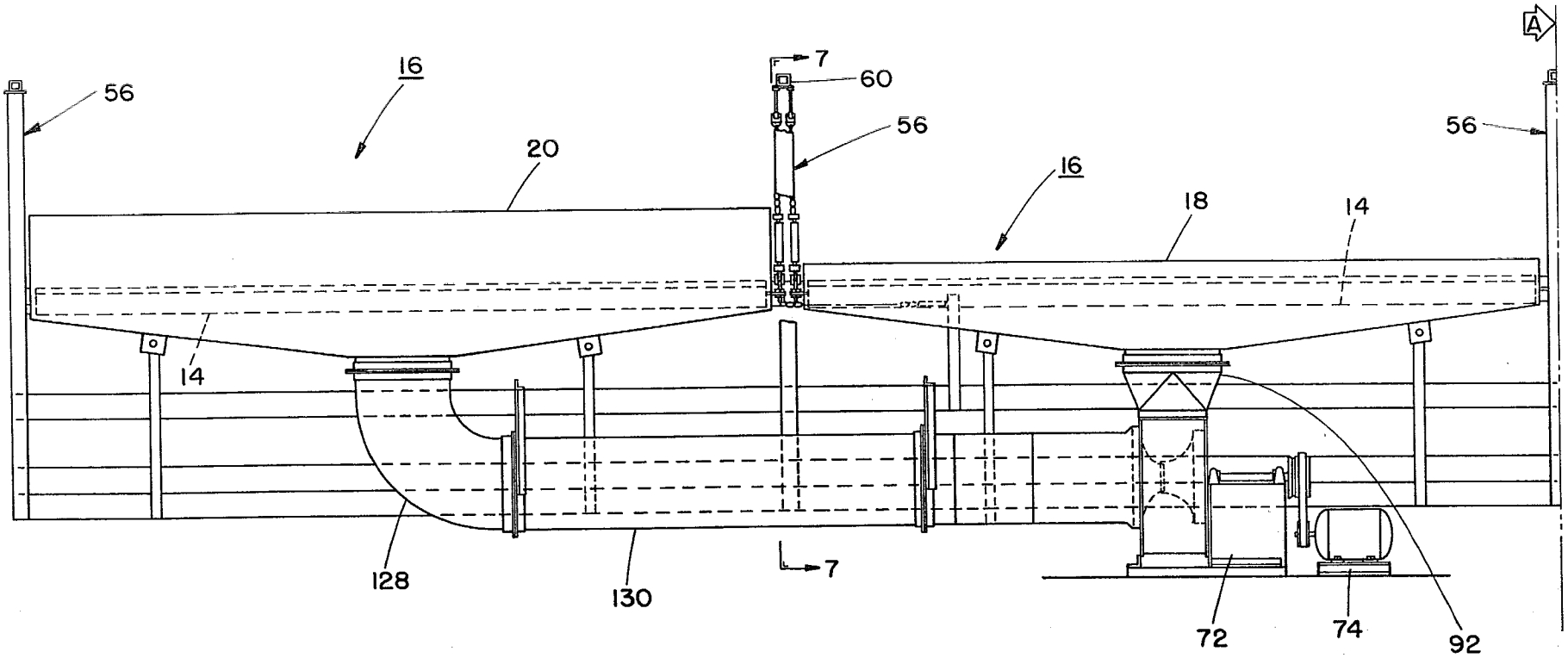
Figure 6B:
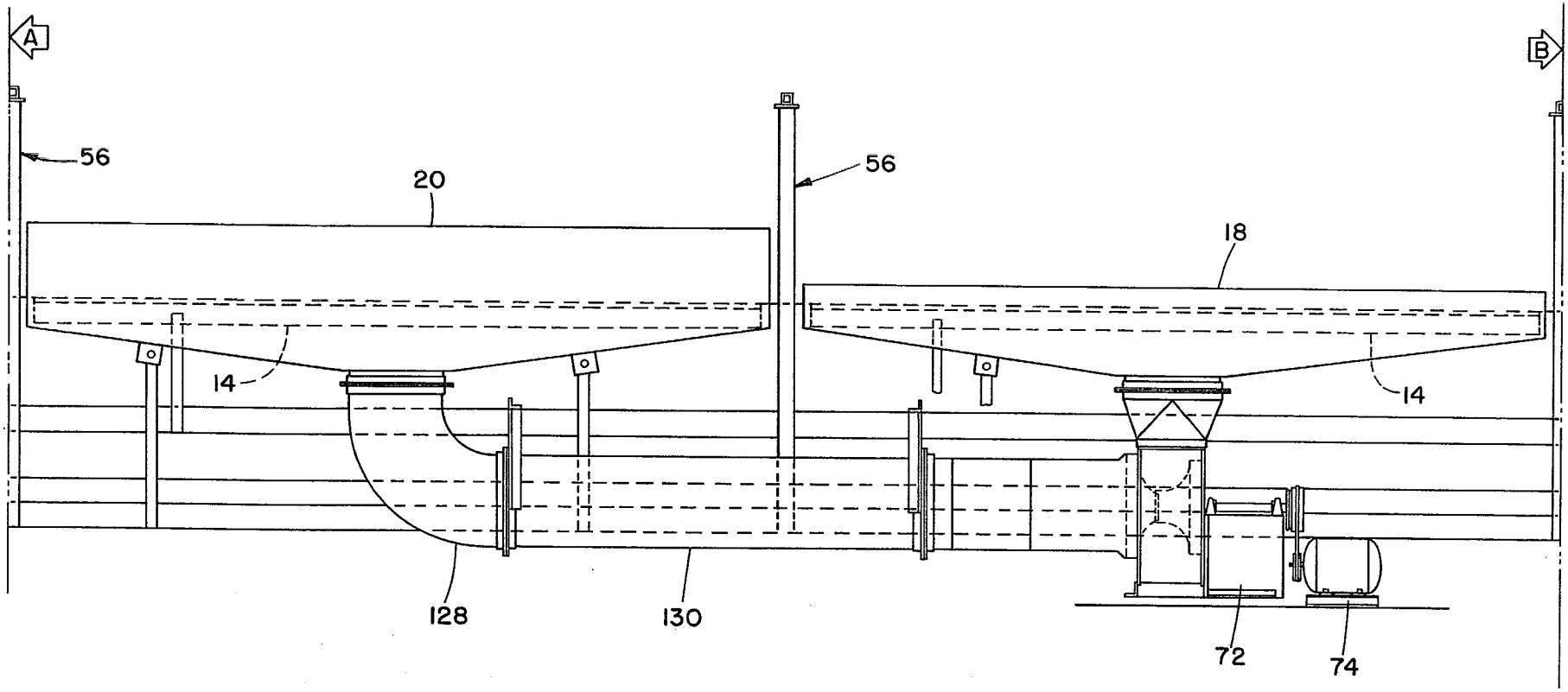

The final downstream air return plenum 20, as shown in FIGS. 6*c* and 8*c* of the drawings, may be provided with an outlet duct 134 and a suitable motor-driven exhaust blower in order to vent moisture-laden drying air from the apparatus 10. If desired, this air may be dehumidified, reheated and returned to the first upstream air outlet plenum 18 of the apparatus for renewed use.

OPERATION OF THE APPARATUS

The operation of the preferred embodiment of the air drying apparatus of the invention is generally as follows:

An aqueous slurry of, for example, reconstituted tobacco is cast onto the endless conveyor belt 12 traveling in the direction of arrow S upstream of the apparatus 10 so as to form a coating or approximately 0.015 inch thick slurry on the upper run of the belt. The reconstituted tobacco slurry may have a water content of about 75 to 90% by weight, or a composition as disclosed in the abovementioned Schmidt et al U.S. patent application Ser. No. 18,814.

The tobacco slurry may be cast onto the endless conveyor belt 12 through the intermediary of a suitable casting apparatus (not shown) known in the prior art, or by means of a tobacco slurry making apparatus as disclosed in copending and commonly assigned U.S. application Ser. No. 1,248 of Otto K. Schmidt, filed Jan. 5, 1979 now abandoned and incorporated herein by reference.

Figure 15:
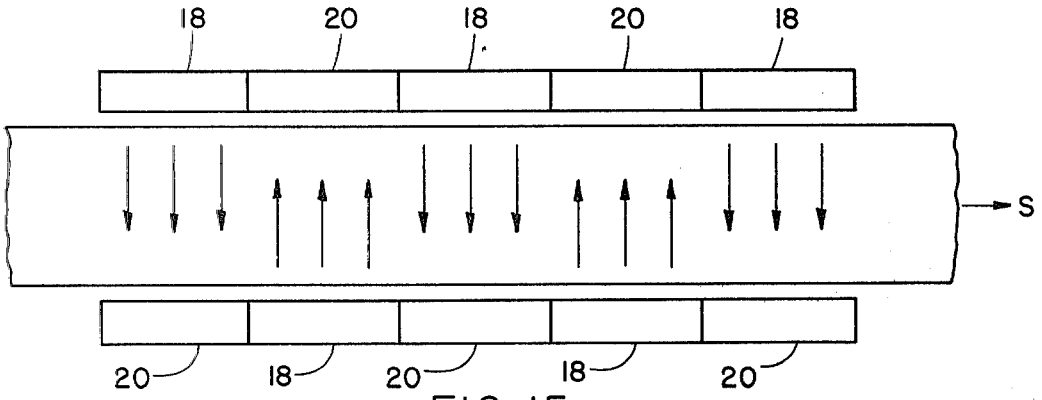
FIG. 15 is a schematic representation of the apparatus of FIG. 1.

The air drying apparatus may be constituted of a plurality of drying sections 16 arranged in series along the path of travel of the belt 12, as shown in FIG. 1 of the drawings. Each air drying section 16 includes a pair of air outlet and return plenums 18, 20 arranged opposite each other on opposite sides of the belt 12. In a preferred arrangement of the air drying apparatus 10, as illustrated schematically in FIG. 15, five drying sections 16 are provided in series so as to form an elongated slurry drying zone. As shown, air outlet plenums 18 and air return plenums 20 alternate along the same side of the belt 12.

As the upper run of endless conveyor belt 12 supporting the slurry enters the first drying section 16 at the upstream or inlet end of the drying apparatus 10, the bottom surface of the belt is exposed to a stream atmosphere produced by a first steam box 14 which is suspended beneath the upper run of the belt. Steam may be supplied to the steam box from a suitable source (not shown) at a pressure of 3 psig and at a steam temperature of about 215° to 218° F. The resultant steam cloud beneath the belt 12 will heat the latter, possibly to a temperature of 200° F. at the inlet to the apparatus, and through the available heat transfer cause evaporation of moisture from the slurry to thusly cause the formation of a continuous film of condensing vapor above the slurry.

A stream of drying air projected across the surface of the slurry transversely of the direction of travel of belt 12 from the first air outlet plenum 18 in a direction towards the air return plenum 20 located directly oppositely thereto on the other side of the belt. The air is preferably dehumidified and preheated to a temperature of about 230° F. by an air preheater or heating coil (not shown). The drying air may be supplied to the apparatus 10 at an initial volume of about 6500 cu. ft./min. and wherein the air exits from the air outlet plenum 18 at a velocity in the range of about 1,000 to 10,000 ft./min., with the preferred velocity for a tobacco slurry being about 3,400 ft./min.

The upward slope of the inlet nozzle or intake of the air return plenum 20 and the baffle plates 132 extending across the belt 12 and slurry so as to interconnect the ends of the plenums 18 and 20 on opposite sides of the belt will ensure that drying air losses are held to a minimum.

Although the upper surface of the belt 12 may not be completely flat as a result of thermal and operational distortions, and the slurry itself may evidence irregularities or obstructions in the surface thereof, the flow of drying air will closely adhere to the surface due to the Coanda effect of streaming high-velocity air. In essence, the Coanda effect is the phenomena of the reattachment of fluid jets, such as high-velocity air streams, to smooth boundary surfaces, in which the flow of air will curl around an obstruction and attempt to adhere thereto.

As the drying air traverses the width of the conveyor belt, the vapor film about the slurry is entrained therein and conducted into the air return plenum 20. The returned air may then be conveyed from the plenum 20 to the inlet of an adjoining upstream air outlet plenum 18 on the same side of the conveyor belt 12 from which it is then propagated across the surface of the slurry transversely of the belt in the opposite direction of the air flow in the preceding drying section 16. This, in effect, will provide air sweep across the belt 12 and the slurry in counter directions so as to assure that a uniform drying sequence will be imparted to the slurry as the latter is conveyed through the air drying apparatus 10.

As illustrated in the drawings, the return or recycling of air from the air return plenums 20 to the air outlet plenums 18 will create a complete air drying cycle within the apparatus. Furthermore, a separate steam box 14 is arranged below each drying section 16 to thereby produce the required vaporization from the slurry at each section of the apparatus.

The apparatus 10 as illustrated herein is shown to contain five air drying sections 16 each preferably of twelve feet in length so as to produce a sixty foot long air drying apparatus. However, within the scope of the invention it is also possible to contemplate a larger or lesser number of drying sections, depending upon the type of materials employed in the slurry or the degree of drying required. In this connection, it is possible to vary the operative length of the basic apparatus without structural modifications by suitably incorporating bypass conduits and valving intermediate the individual drying sections of the air drying apparatus thus either eliminating or adding operational drying sections.

DESCRIPTION OF ALTERNATIVE EMBODIMENTS

Various modifications of the air drying apparatus readily support themselves to one skilled in the art, having reference to FIGS. 16 to 21 of the drawings in which like or similar components are designated by the same reference numerals.

Figure 16:
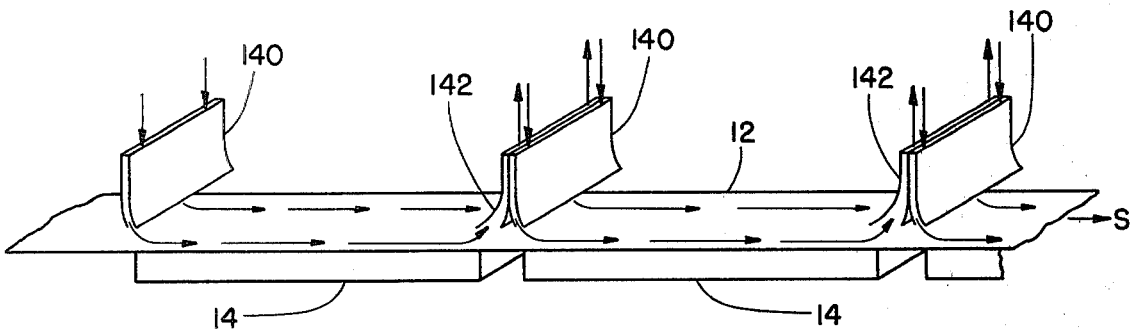
FIG. 16 is a schematic perspective view of another embodiment of the air drying apparatus.

In the embodiment depicted in FIG. 16, a plurality of air outlet conduits 140 extend at spaced intervals across the conveyor belt 12 so as to expel streams of air to flow along the path of travel of the belt. Located adjacent the conduits 140 are air return conduits 142 which will assume return air and entrained moisture vaporized from the slurry.

Figure 17:
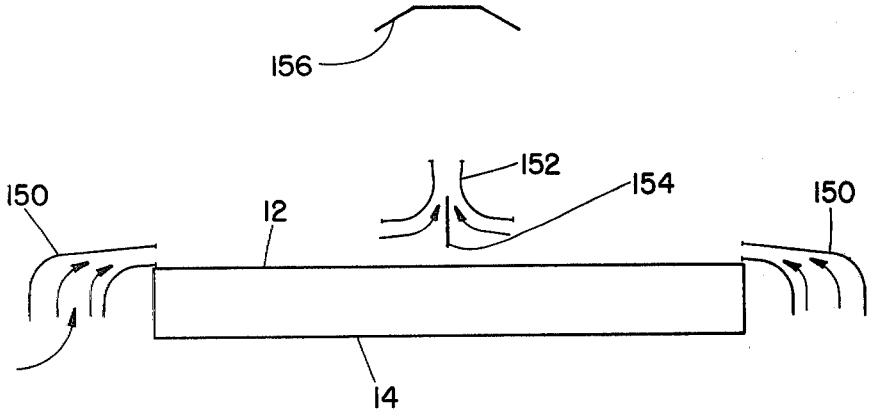
FIG. 17 is schematic transverse sectional view of another embodiment of the air drying apparatus.
Figure 18:
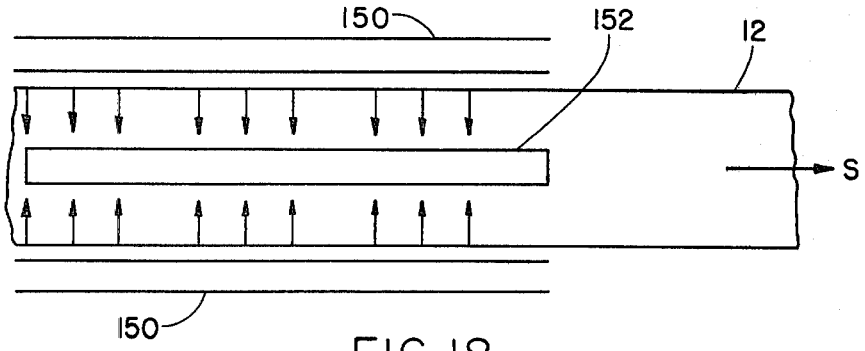
FIG. 18 is a top plan view, on a reduced scale, of the apparatus of FIG. 17.

The embodiment of FIGS. 17 and 18 shows air outlet plenums 15 forming streams of drying air to flow from the sides of the conveyor belt 12 towards the longitudinal centerline thereof normal to the direction of travel of the belt. Return air with entrained moisture from the slurry is taken up by air return duct 152 below which a deflector 154 will guide the air into the duct. A suitable hood 156 above the air return duct 152 will cause the air to be dispensed in the surrounding atmosphere.

Figure 19:
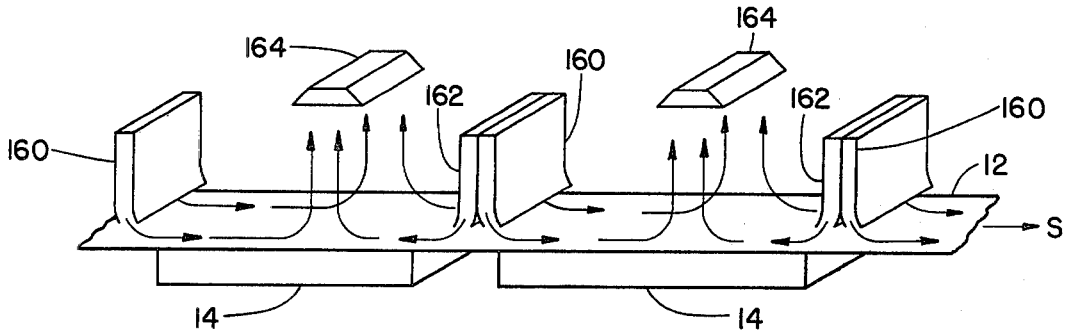
FIG. 19 is a schematic perspective view of a further embodiment of the inventive apparatus.

The structure illustrated in FIG. 19 shows an arrangement of air outlet ducts 160 and 162 extending transversely across the conveyor belt 12 adapted to impart flows of drying air across the slurry in directions along the travel path of the conveyor belt and also countercurrent thereto. Suitable hoods 164 may be located above the belt intermediate the ducts 160 and 162 for diverting moisture-laden return drying air.

Figure 20:
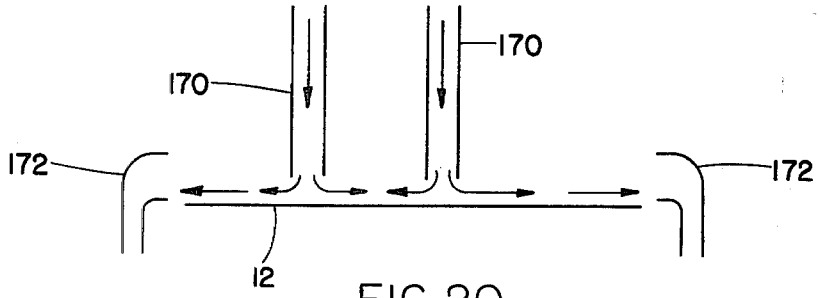
FIG. 20 is a schematic transverse sectional view of another embodiment of the inventive apparatus.
Figure 21:
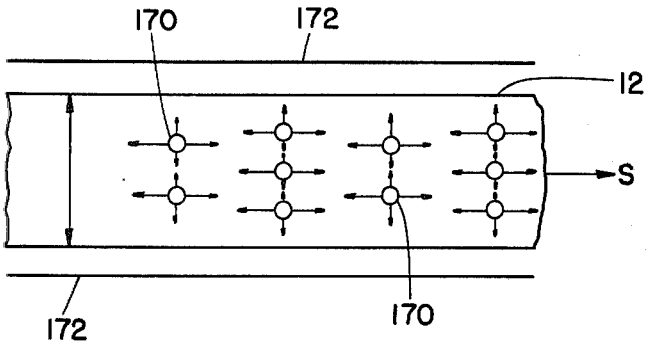
FIG. 21 is a top plan view, on a reduced scale, of the apparatus of FIG. 20.

As shown in FIGS. 20 and 21 of the drawings, vertically depending drying air outlet conduits 170 direct air downwardly and radially outwardly onto the slurry, and with moisture-entrained return air being directed to air return plenums 172 located to extend along both sides of the conveyor belt.

Although various embodiments of the inventive air drying apparatus have been disclosed and described herein, other modifications will fall within the scope of the invention and the appended claims.

What is claimed is:

1. An apparatus for the removal of moisture from an aqueous slurry to provide a uniformly dried material, comprising a horizontally movable support means having an upper surface supporting said slurry thereon;

a chamber arranged below and closed at its top by said movable support means, and steam ejecting means for forming a steam atmosphere in said chamber uniformly heating said slurry moving across said chamber on said support means thereby forming a condensing vapor from said slurry above said support means;

means disposed on opposite sides of said support means for creating a flow of drying air open to atmosphere along parallel paths first in one direction and then in the opposite direction transverse to the direction of movement of said support means; and the flow of drying air moving across the upper surface of said support means being of sufficient velocity to create a continuous turbulent flow resulting from the Coanda effect from one side of said support means to the other at the surface of said slurry thereby removing and entraining said condensing slurry vapor and providing a uniformly dried material.

2. An apparatus as claimed in claim 1, said chamber and steam ejecting means comprising steam box including parallel spaced first and second steam plenum chambers extending below the bottom edges of and in the direction of movement of said movable support means;

a plurality of spaced steam conduits extending between and communicating alternately with said first and second plenum chambers; and a plurality of steam outlet orifices being formed in each of said conduits;

said outlet orifices being upwardly directed towards and sufficiently spaced from the bottom surface of said slurry support means so as to provide said steam atmosphere below said support means adapted to impart the heat thereof to said support means and to cause said slurry to form said condensing vapor.

3. An apparatus as claimed in claim 2, and said slurry support means comprising an endless belt conveyor having a horizontally disposed flat upper run and said slurry being supported on the upper surface of said upper run;

said first and second steam plenum chambers being disposed below respectively the opposite edges of said upper run and extending in the direction of movement of said endless belt; and said steam conduits extending transversely of said endless belt.

4. An apparatus as claimed in claim 3, and further comprising means for suspending said steam box below the upper run of endless belt conveyor for movement with said belt when said belt tracks transversely to its direction of movement.

5. An apparatus as claimed in claim 4, and said suspending means for said steam box comprising eye bolts fastened to said steam box and being adapted to be connected to flexible suspension means for suspending said steam box from an overhead support structure.

6. An apparatus as claimed in claim 1, and said movable slurry support means comprising an endless belt conveyor being impervious to fluid and having a generally horizontal flat upper belt run supporting said slurry.

7. An apparatus as claimed in claim 1, and said means for creating said flow of drying air comprising an air supply plenum having an air outlet nozzle extending along each side of said movable support means;

an air return plenum extending along each side of said support means opposite from and coextensively with said air outlet nozzles; and said air return plenums each having air inlet duct for receiving the flow of air from said opposed air outlet nozzle and entrained condensing vapor from said slurry intermediate said opposed air supply plenum.

8. An apparatus as claimed in claim 7, comprising blower means in said air supply plenum for conveying pressurized high-velocity drying air to said air outlet nozzle.

9. An apparatus as claimed in claim 7, and each of said air outlet nozzles comprising an elongate narrow outlet duct extending along and above said side of said movable slurry support means;

and at least one baffle means being located in said outlet duct for sub-dividing and orienting the flow path of air emanating therefrom.

10. An apparatus as claimed in claim 7, comprising a plurality of said air supply plenums and air return plenums being arranged on opposite sides of said movable slurry support means, said plenums being spaced along the path of movement of said support means so as to define an extended drying zone for said slurry, said air supply plenums and said air return plenums being located in alternating relationships along said drying zone, each air supply plenum on one side of said support means having an air return plenum positioned oppositely thereof on the opposite side of said slurry support means.

11. An apparatus as claimed in claim 10, comprising conduit means connecting at least some of said air return plenums to an adjacent upstream positioned air supply plenum located on the same side of said slurry support means so as to provide a continuous drying air flow circuit within said extended slurry drying zone.

12. An apparatus as claimed in claim 10, comprising blower means connected to each said air supply plenum for supplying high-velocity drying air to each said air outlet nozzle.

13. An apparatus as claimed in claim 10, said flow of air from the outlet nozzle of said air supply plenum being directed in close parallel relationship with the upper surface of said slurry support means and substantially transverse to the direction of longitudinal movement of said support means.

14. An apparatus as claimed in claim 10, and a plurality of said steam ejecting means, and a plurality of said chambers each defined by a steam box; and each pair of air supply plenums and oppositely arranged pair of air return plenums having a different one of said steam boxes associated therewith.

15. An apparatus as claimed in claim 1, said steam being supplied from said steam ejecting means at a pressure of about 3 psig and at a temperature within the range of about 215° to 220° F.

16. An apparatus as claimed in claim 1, said drying air flowing across said slurry at a velocity within the range of about 1,000 to 10,000 ft./min.

17. An apparatus as claimed in claim 1, said drying air having an initial temperature of about 230° F.

18. An apparatus as claimed in claim 1, said drying air being supplied at a volume of about 6500 cu. ft./min.

19. An apparatus as claimed in claim 1, said slurry comprising a reconstituted tobacco slurry having a water content of about 75 to 90% by weight.

20. A method of removing moisture from an aqueous slurry to provide a uniformly dried material, comprising the steps of applying a layer of slurry on to the top run of an impervious endless belt conveyor;

moving said slurry through a drying zone by said conveyor;

uniformly heating with a steam atmosphere below the upper run of the conveyor said slurry as it moves through said drying zone thereby forming a condensing vapor;

providing a flow of drying air along parallel paths in opposite directions open to atmosphere within said drying zone of sufficient velocity to create a continuous turbulence resulting from the Coanda effect across the width of said conveyor thereby removing and absorbing said condensing vapor from the surface of said slurry and providing a uniformly dried material.

21. The method as claimed in claim 20, further comprising the steps of providing a chamber closed at its top by the upper run of said conveyor; and ejecting steam into said chamber alternately from opposite sides thereof thereby creating said steam atmosphere in said chamber.

22. The method as claimed in claim 20, further comprising the steps of providing a supply plenum with a drying air outlet nozzle extending along each side of said conveyor thereby providing the flow of said drying air along parallel paths; and providing a return plenum on each side of said conveyor and aligned with said plenum on the opposite side of said conveyor;

each return plenum having an inlet duct being of greater height and coextensive with the nozzle of said aligned supply plenum thereby receiving the flow of said drying air therefrom.

* * * * *